US005785638A

United States Patent [19]

Bristo et al.

[11] Patent Number: 5,785,638

[45] Date of Patent: Jul. 28, 1998

[54] MAILPIECE HANDLING APPARATUS

[75] Inventors: Mark S. Bristo, Harlow; David J. Ricketts, Chelmsford, both of United Kingdom

[73] Assignee: Pitney Bowes Inc., Stamford, Conn.

[21] Appl. No.: 526,815

[22] Filed: Sep. 11, 1995

[30] Foreign Application Priority Data

Sep. 12, 1994 [GB] United Kingdom ..... 9418333

[51] Int. Cl.[6] ..... B65H 45/14

[52] U.S. Cl. ..... 493/420; 493/421; 53/117; 53/284.3; 53/206

[58] Field of Search ..... 271/9.01, 4.05, 271/10.04, 10.05; 53/284.3, 206, 460, 117, 429; 493/420, 421

[56] References Cited

U.S. PATENT DOCUMENTS 3,975,009 8/1976 Brown ..... 493/421

4,717,134 1/1988 Iida ..... 493/421

4,942,535 7/1990 Francisco ..... 364/468

5,511,357 4/1996 Ricketts ..... 53/284.3

*Primary Examiner*—Jack W. Lavinder

*Attorney, Agent, or Firm*—Christopher J. Capelli; Melvin J. Scolnick; Robert Meyer

[57] ABSTRACT

In the field of mailpiece handling apparatuses, it is known to provide machines having DC drives for all components thereof. However, the use of DC drives exclusively is expensive. On the other hand, AC drive frequently do not provide a sufficient degree of precision in the controlling of mailpieces in the machines. The disclosure relates to a folder-inserter-sealer machine (10) having a first, AC electric motor (28) connected to drive a first set of driveable components on the apparatus: and one or more further, DC electric actuators (18;27) operatively connected to drive a further set of driveable components of the apparatus. An advantage of the arrangement is that precise control of components may be obtained in a comparatively low-cost machine.

14 Claims, 2 Drawing Sheets

MAILPIECE HANDLING APPARATUS

BACKGROUND OF THE INVENTION

This invention relates to a handling apparatus in particular but not exclusively for mailpieces. Mailpiece handling apparatuses include postage meters, mailpiece folders, folder-inserters and folder-inserter-sealer machines. The invention may be employed in any mailpiece handling apparatus in which it is desirable to provide two or more discrete electric drives. The invention is of particular utility in folder-inserter and folder-inserter-sealer machines, referred to herein by the general term 'folder-inserters'.

The construction of a folder-inserter is determined primarily by budgetary considerations. The market for folder-inserter machines is highly competitive, and it is important for manufacturers of such machines to minimize expenditure on components within the machines.

Folder-inserters usually include a plurality of different drives, for example for driving mailpieces through the apparatus on drive belts or between pairs of driven rollers; and also for adjusting components within the folder-inserter, such as the positions of stops in fold plates; the positions of deflectors for the mailpieces; and also for feeding sheets from sheet trays into the machine. It is known in the most expensive folder-inserts to provide these functions exclusively by means of DC drives such as stepper motors. The advantage of using DC components is that a precise degree of control over the positioning of mailpieces and subcomponents of the apparatus can be achieved, to a standard deemed acceptable in high cost machines.

When DC drives are used exclusively in a folder-inserter, the complexity of the control apparatus in the machine increases commensurately. It is usual to provide a dedicated motor control processor which control respective DC drives in the machine.

The use of a complicated, dedicated processor can increase the manufacturing cost of the folder-inserter and additionally lead to a greater requirement for screening of components against radio frequency interference (RFI). (The multi-channel output of the processor is susceptible to corruption by interference from other sources, and also the DC drives themselves can generate RFI that affects the other processing functions in the apparatus).

In contrast, in a low cost folder-inserter it is usual to provide a single, continuously running AC motor and a simplified (i.e. on-off) control arrangement. The AC motor is connected via timing belts to a series of driven pulleys keyed to transport rollers or other subcomponents of the machine. Each driven pulley is associated with an adjustable clutch (e.g. a solenoid actuated clutch), whereby drive to the pulley or roller may be connected and disconnected.

The clutches may be controlled by mechanical trip sensors, or, more commonly, electrical or electronic devices that sense the positions of mailpieces within the apparatus and adjust the clutches in accordance with a program stored in the processor of the folder-inserter. Since actuation of the clutches takes place by virtue of a simple on-off signals, the sophistication of the processor needed to control the clutches is less than that required in a folder-inserter using DC drives exclusively.

While folder-inserter using a single AC drive may be manufactured at a much lower cost than machines employing DC drives exclusively, the precision of positioning of mailpieces within the apparatus and of subcomponents of the apparatus is markedly less than when DC drives are employed.

Moreover, it can be difficult to provide effective feedback control in folder-inserters using an AC drive because of the cost and complexity of the electronic circuits required.

There is a need for a folder-inserter which retains the precision of control provided by DC drives, whilst not requiring complex and expensive control and shielding apparatus in respect of all components.

SUMMARY OF THE INVENTION

According to the invention, there is provided a handling apparatus for laminar items, e.g. mailpieces, comprising a first electric actuator operatively connected to drive a first set of driveable components of the apparatus; and one or more further electric actuators operatively connected to drive a further set of driveable components of the apparatus, wherein the first electric actuator is an AC device and the or each further electric actuator is a DC device; and arrestation and/or collation of laminar items in the apparatus occurs by virtue of the activation or deactivation of components additional to the first set of driveable components.

The first set of driveable components of the apparatus can advantageously be selected to be those for which precise position and speed control are not required. The second set of components are, preferably, those in respect of which a high degree of such precision is required. For example, in preferred embodiments, the second set of driveable components may include one or more drive members for feeding laminar items from a store therefor into the apparatus; one or more members constituting or for moving one or more moveable stops for laminar items; or one or more members constituting or for driving one or more deflectors for laminar items.

When configured in this way, a folder-inserter can be manufactured with a simpler processor, and also RFI is less of a problem than in previous, high cost folder-inserters. In addition, the apparatus can be constructed at a moderate cost.

The arrangement of the invention is ideally suited for use on mid-price folder-inserters whose throughput is less than that of the most expensive folder-inserters, wherein there is a reduced need for accurate speed and position control of some components in the apparatus. The arrangement of the invention advantageously allows such components to be powered by a relatively low cost arrangement, i.e. the AC actuator, whilst retaining the use of high precision DC devices for certain other functions of the machine.

Moreover, the DC power consumption of a folder-inserter or other mailpiece handling apparatus configured in accordance with the invention is less than that of a comparable apparatus using DC drives exclusively. This in turn means that a lower output DC power supply unit may be specified in the machine, thereby minimizing the manufacturing costs.

Preferably, the first set of driveable components is incorporated in a main transport path of the apparatus. The main transport components, such as drive rollers and drive belts, are those that are required to be controlled with the least precision in the folder-inserter.

Conveniently, the AC motor is arranged to run continuously while the apparatus is in operation. This is an economical way of running an AC device. If it is necessary at times to slow or stop certain components driven by the AC motor, it is possible to incorporate suitable, adjustable clutches in the drive train between the AC motor and the relevant driven component whereby to provide control over the speed of the component.

Preferably, the apparatus includes a switch for switching the power supply to the first electric actuator; and a controller capable of generating pulse control signals for controlling one or more DC devices in the apparatus.

Such splitting of the control for the respective kinds of actuator in the apparatus firstly has the advantage that radio frequency shielding of the control devices can be achieved more readily, by virtue of spacing of the control components from one another in the apparatus. Secondly, as indicated above, the use of a dedicated DC controller minimizes manufacturing costs of the apparatus because a comparatively low specification device can be employed, at low cost, for controlling the DC actuators.

When the AC actuator is a rotary AC motor, the output shaft thereof is preferably drivingly connected to one or more rollers in a main transport path for driving a mail piece through the apparatus.

Conveniently, the apparatus includes a base portion and a superstructure, wherein the first electric actuator is disposed within the base portion and the further electric actuators are disposed generally in or on the superstructure.

The invention also relates to a control apparatus for a mailpiece processing apparatus according to the invention, the control apparatus comprising:

a power supply unit, including a switch, connected to the first electric actuator whereby to switch power supplied to the first electric actuator; and a first processor capable of generating pulsed control signals and operatively connected to the power supply and to the or each further electric actuator.

The splitting of the control apparatus according to whether the AC actuator or the DC actuators are to be controlled has advantages as set out hereinabove.

Conveniently the control apparatus includes one or more transducers operatively connected to the first processor, the first processor being programmed to generate pulse control signals in dependence on the logic levels of the or a said transducer.

Optionally, a further processor may be incorporated between the transducers and the first processor. In practical embodiments of the invention, the further processor would in fact be the main processor for the apparatus and the first processor, which is dedicated to the controlling of the DC drives, would be a slave device under the control of the further processor.

DESCRIPTION OF THE PREFERRED EMBODIMENT

Figure 1:
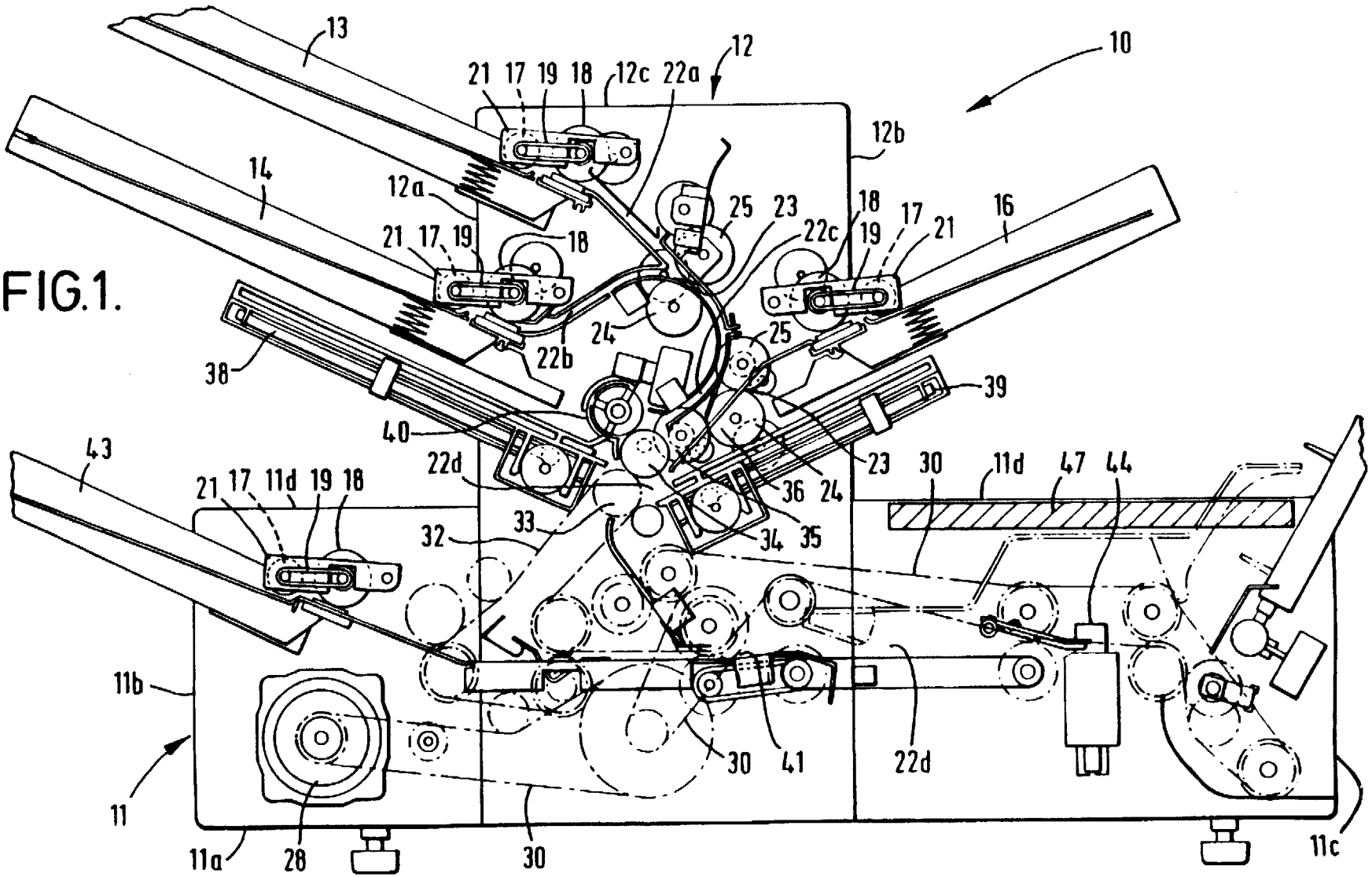
FIG. 1 is an elevational view of a folder-inserter-sealer constructed in accordance with the principles of the invention.

Referring to the drawings, there is shown a folder-inserter-sealer 10 comprising a base portion 11 and a superstructure 12. Base portion 11 is constituted as a housing having a bottom 11*a*; upstanding side walls of which two, 11*b*, 11*c*, are visible in FIG. 1; and a top wall 11*d*.

Superstructure 12 is also constituted as a housing having upstanding side walls 12*a*, 12*b* and a generally horizontal top wall 12*c*. Superstructure 12 is received in an aperture in the top wall 11*d* of base portion 11. Base portion 11 and superstructure 12 normally also include front and rear upstanding side walls 12*a*, 12*b* thereof. The apertures are adapted releasably to receive feeder trays for mailpiece items such as letters, insert sheets, bank statements, cheques, etc.

There are three feeder trays 13, 14, 16 in the embodiment shown in FIG. 1. The uppermost feeder tray 13 is disposed in an aperture in the left hand upstanding side wall 12*a* of superstructure 12. Feeder tray 13 is known as a 'sheet feeder' tray and is intended to receive a stack of, e.g., letters to be inserted into envelopes.

A further, similar sheet feeder tray 14 is disposed on the same side of superstructure 12 a short distance below feeder tray 13.

A feeder tray 16 is disposed in an aperture on the opposite side of superstructure 12. Feeder tray 16 is an 'insert feeder' tray that is intended to receive, store and dispense a stack of inserts to be added to envelopes in conjunction with, e.g., the letters etc. fed from the sheet feeders 13 and 14. When the apparatus is sited in, for example, a bank, the sheet feeder trays 13 and 14 may be employed to store and dispense banks statements into the apparatus 10 whilst the insert feeder tray 16 could be employed, for example, to store and dispense advertising notices for bank customers.

Regardless of the precise function of each feeder tray 13, 14, 16, sheets or inserts are fed from each feeder tray by means of a respective driven roller 17 that is hingeable into and out of engagement with the uppermost sheet of the stack stored in the relevant feeder tray.

Each driven roller 17 is driven by means of a respective DC feeder motor 18. Each DC feeder motor 18 is drivingly connected to its associated feeder roller 17 be means of a drive/timing belt 19. The subassemblies constituted by the feeder roller 17, the DC feeder motors 18 and the drive/timing belts 19 are respectively hingeably mounted on suitable hinge plates 21. Each hinge plate 21 is hingeable under the control of a lever (not shown) or optionally a solenoid (not shown) to hinge the feeder roller 17 selectively into and out of engagement with the stack of sheets in the relevant feeder tray 13, 14, 16. (In general the roller 17 is in engagement with the stack, and in the embodiment shown the withdrawal of a roller 17 is only occasionally required.)

The folder-inserter-sealer 10 includes a plurality of convergent transport sub-paths 22*a*, 22*b*, 22*c* for items fed from the feeder trays 13, 14, 16. The transport sub-paths 22*a*, 22*b*, 22*c* merge into a single, main transport path 22*d* in the region of the superstructure 12 disposed beneath the feeder trays.

The transport sub-paths 22*a*, 22*b*, 22*c* incorporate respective drive nips 23 each constituted by a driven roller 24 in peripheral, nip-forming engagement with a freely rotatable roller 25. Each driven roller 24 is drivingly connected to the output shaft of a respective further DC motor.

The nips in the transport paths 22*a*–22*c* for grip the leading edges of sheets such as inserts or letters and drive them along the transport path.

It will be appreciated that the feeder motors 18 and the DC motors driving the driven rollers 24 must be controlled to a high degree of positional and speed accuracy. This is because feeder-inserter-sealers are frequently required to process many hundreds of letters, inserts, etcetera a minute, and consequently the sheets are fired from the feeder trays 13, 14, 16 at a very rapid rate. The timings of the firings of sheets and the speeds of the sheets through the apparatus must be very accurately controlled to ensure that, for example in a collation operation, all the sheets through the apparatus must be very accurately controlled to ensure that, for example in a collation operation, all the sheets being processed in the apparatus arrive at the requisite point in the apparatus at the correct time.

It is additionally desirable to arrest the moving sheets virtually instantaneously in the apparatus, and this may be achieved readily by virtue of the characteristics of DC devices.

Accordingly, it is highly advantageous for the feeder motors 8 and the DC motors for the transport rollers in the transport paths 22*a* to 22*c* to be DC devices.

Beneath the point in the folder-inserter-sealer 10 at which the three transport sub-paths 22*a* to 22*c* merge into main transport path 22*d*, the majority of the drives in the apparatus are under the control of a continuously running AC motor 28 located towards the bottom of the base portion of the machine 10.

Primarily, the AC motor 28 drives a series of transport rollers in the main transport path 22*d* running generally horizontally along the base portion of the folder-inserter-sealer 10. Drive to such rollers is transferred by means of a plurality of suitable timing belts 30. In addition, a further timing belt 32 transfers drive (indirectly) from the AC motor 28 to a driven fold roller 33 in driving peripheral engagement with one of a chain of three further, mutually engaged fold rollers 34, 35, 36. The fold rollers 33–36 constitute a series of folding nips disposed respectively at the ends of two fold plates 38, 39 of known construction. The fold plates are supported in apertures in the side walls 12*a*, 12*b* on opposite sides of the superstructure 12 below the lowermost feeder trays 14, 16 and approximately at the level of the boundary between the 12 and the base portion 11.

In general, the fold rollers 33–36 of a folder-inserter-sealer are not required to stop and start during operation of the apparatus, and instead run continuously. The drive nips 23 in the superstructure 12, in conjunction with the deflectable closure plate 40 selectively moveable across the mouth of the fold plates 38 serve to determine whether a given nip between a given pair of fold rollers 33–36 is employed for the folding of sheets. In other words, the sheets are only driven into the nip between a pair of fold rollers 33–36 in the event that the machine software determines that a particular type of fold should be made. Such determinations are made in dependence on the size of sheet being folded and the fold configurations selected by an operator of the machine 10.

Once any folds have been made in the sheets, the primary purpose of the apparatus is to transport the sheets to a collation position 41 at which they are fed into a stationary envelope fed from an envelope feeder 43. The folder-inserter-sealer includes means (not shown) for holding an envelope stationary at collation position 41 for receiving folded inserts (sheets). The position at which the envelopes are arrested is determined by the virtually simultaneous withdrawal on a hingeable member of a selectively moveable drive roller 31 from driving engagement with an envelope; and the actuation of one or more gripper fingers for gripping the envelope immediately after withdrawal of the drive roller. The drive roller 32 is one of the components connected via a timing belt 30 to the output of AC motor 28 and consequently roller 31 operates continuously while the machine is switched on. The removal of drive to the envelope is achieved by actuation or deactivation (as appropriate) of a suitable DC solenoid (not shown). Thus there is not a strong need for the drive roller 31 itself to provide precise control of the envelope position.

Moistening of the envelope flap and sealing of the envelope subsequently take place in a sealer station 44 of a generally known kind.

The envelope feeder 43 is some that similar to the sheet feeder trays 13, 14 and 16, and is associated with a DC feeder motor 18 and driven roller 17 mounted on a hinge plate 21 for feeding of envelopes in a similar manner to that in which sheets are fed from the sheet feeders 13, 14 and 16.

Thus, in the embodiment of FIG. 1 use is made of an AC drive for those components that are not required to be controlled to a high degree of accuracy; whereas DC drives are employed in respect of sheets, inserts, etc., that must be fired to precise timings or that must be positioned and speed controlled to a high degree of accuracy. Since the components constituting the DC drives are comparatively light in weight, it is acceptable from the point of view of stability of the machine 10 for such components in general to be disposed in the superstructure 12, the exception being the DC drive arrangement for the envelope feeder 43 (which is disposed in the base portion 11). On the other hand, since the AC motor 28 is a comparatively heavy item, and since the machine can be arranged so that the components to be driven by the AC motor 28 are disposed towards the exit of the machine, it is expedient (although not essential) to locate the AC motor and the components that it drives in the base 11 of the machine 10, thereby improving the stability of the device.

The main processor 46 (FIG. 2) of the machine 10 is located in the vicinity of the operator keyboard 47, at the right hand end of the base portion as shown in FIG. 1. The use of a continuously running AC motor plus suitable timing belts in this portion of the machine 10 minimizes the risk of radio frequency interference corrupting messages in the main processor 46.

Figure 2:
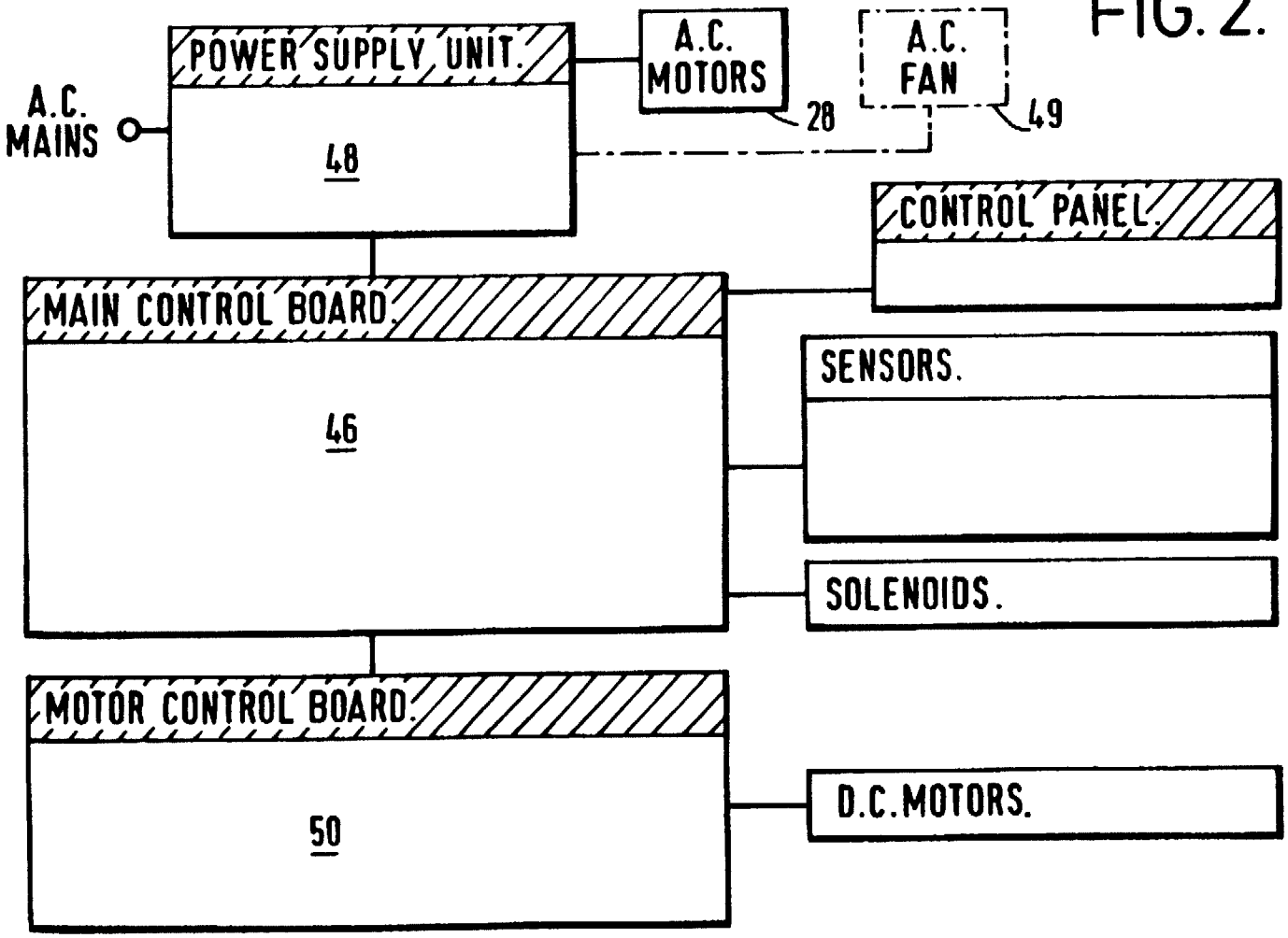
FIG. 2 is a schematic representation of control apparatus incorporated into the folder-inserter-sealer of FIG. 1.

Reference to FIG. 2 shows the control architecture of the apparatus.

Main processor 46 is supplied by a switch mode power supply unit 48 that is wired directly to the AC motor 28 and a continuously running AC fan 49. Communications buses link the main processor 46 to a control panel and keyboard circuit; to transducers located at various points on the machine to check for the presence or absence of sheets and hence to determine whether operation of the machine is taking place satisfactorily; to the DC solenoids; and to a further processor 50, which is dedicated to the control of the DC motors 18.

In practice, the main processor 46 and the dedicated processor 50 are contained on a single board, but it is useful nonetheless to separate the functions of the two processors. This allows a manufacturer of the machine 10 to specify a comparatively low specification processor 50 for controlling the DC motors (because the motors are all similar in function and therefore can be chosen to have the same performance and consequently be successfully controlled by respective, identical sets of control messages).

One reason for this is that the software programs stored in the processor 50 are such as to permit operation of the DC motors in both forward and reverse directions. However, the motor drivers associated with the processor 50 need not necessarily be the full bridge drivers normally required for such driving. Where a motor is only ever required to rotate in one direction (for example in the case of the DC motor 18), half bridge driver circuits, permitting unidirectional operation of the motors, may be employed.

The invention can be employed in numerous other apparatuses, such as bank note printing and handling machinery, printing presses and ticket machines, etc. Moreover, although the embodiment has been described employing rotary motors, it is possible to construct versions of the invention in which, for example, linear actuators are employed instead of the DC rotary motors illustrated.

We claim:

1. A handling apparatus for laminar items comprising, a first electric actuator operatively connected to drive a first set of driveable components of the apparatus; and at least another electric actuator operatively connected to drive at least another set of driveable components of the apparatus, wherein:

i) the first electric actuator is an AC device and the at least another electric actuator is a DC device; and ii) arrestation and/or collation of laminar items in the apparatus occurs by virtue of the activation or deactivation of components additional to the first set of driveable components.

2. Apparatus according to claim 1 wherein the first set of driveable components is incorporated in a main transport path of the apparatus.

3. Apparatus according to claim 1 wherein the first electric actuator is an AC rotary motor.

4. Apparatus according to claim 3 wherein the AC motor is arranged to run continuously while the apparatus is in operation.

5. Apparatus according to claim 3 wherein the output shaft of the AC motor is drivingly connected to one or more rollers in a main transport path for driving a mailpiece through the apparatus.

6. Apparatus according to claim 1 including a switch for switching power supplied to the first electric actuator and a controller capable of generating pulsed control signals for controlling one or more DC devices in the apparatus.

7. Apparatus according to claim 1 further including a base portion and a superstructure, wherein the first electric actuator is disposed within the base portion and the at least another electric actuator is disposed generally in or on the superstructure.

8. Apparatus according to claim 1, wherein the at least another set of driveable components includes one or more drive members for feeding laminar items from a store therefor into the apparatus.

9. Apparatus according to claim 1, wherein the at least another set of driveable components includes one or more members for moving one or more moveable stops for laminar items.

10. Apparatus according to claim 1, wherein the at least another set of driveable components includes one or more members for driving one or more deflectors for laminar items.

11. Apparatus according to claim 1 further including control apparatus comprising:

a power supply unit, including a switch, connected to the first electric actuator whereby to switch power supplied to the first electric actuator; and a first processor capable of generating pulsed control signals and operatively connected to the power supply and to the or each further electric actuator.

12. Apparatus according to claim 11 further including at least one transducer operatively connected to the first processor, the first processor being programmed to generate pulsed control signals in dependence on the logic levels of the at least one transducer.

13. Apparatus according to claim 12 further including a further processor operatively connected to the at least one transducer and the first processor.

14. Apparatus according to claim 13 wherein the first set of driveable components includes a set of fold rollers disposed adjacent a fold plate assembly and at least one transport roller for transporting mailpiece through the apparatus.

* * * * *